US007200887B1

(12) United States Patent
Powers

(10) Patent No.: US 7,200,887 B1
(45) Date of Patent: Apr. 10, 2007

(54) BRIDGES ASSEMBLED FROM OCEAN-MOBILE PONTOON BRIDGE MODULES

(76) Inventor: James M. Powers, 3 Santa Lucia Ave., Ormond Beach, FL (US) 32174

( * ) Notice: Subject to any disclaimer, the term of this patent is extended or adjusted under 35 U.S.C. 154(b) by 0 days.

(21) Appl. No.: 11/499,960

(22) Filed: Aug. 7, 2006

Related U.S. Application Data

(60) Provisional application No. 60/796,053, filed on May 1, 2006, provisional application No. 60/762,311, filed on Jan. 27, 2006.

(51) Int. Cl.
*E01D 15/14* (2006.01)

(52) U.S. Cl. ..... 14/27; 14/2.4; 14/2.6

(58) Field of Classification Search ..... 14/2.4–2.6, 14/27
See application file for complete search history.

(56) References Cited

U.S. PATENT DOCUMENTS 1,934,286 A * 11/1933 Torchette ..... 14/27
3,685,074 A * 8/1972 Marshall et al. ..... 14/27
4,297,759 A * 11/1981 Soffge et al. ..... 14/2.6
4,907,759 A * 3/1990 Takeuchi et al. ..... 242/246

* cited by examiner

*Primary Examiner*—Raymond Addie

(57) ABSTRACT

A bridge for long, deep water crossings is supported between spans by narrow, transverse, semi-submersible pontoons. The pontoons are oriented to present minimal cross section to tidal currents under the bridge. The pontoons are pivotally attached to the bridge allowing them to be turned a few degrees right or left as tidal currents change. During fabrication, a module of bridge deck/roadway can be assembled for transport upon each pontoon deck. After remote fabrication two or more complete bridge modules can be linked pontoon-to-pontoon into a seaworthy vessel that can be towed to the erection site. At site the roadway modules are rotated transverse to the pontoon, elevated to final position and joined to other modules, completing the bridge.

17 Claims, 6 Drawing Sheets

BRIDGES ASSEMBLED FROM OCEAN-MOBILE PONTOON BRIDGE MODULES

CROSS REFERENCE TO RELATED APPLICATIONS

This application claims priority under 35 USC § 119(e) of U.S. Provisional Application No. 60/762,311, filed on Jan. 27, 2006, also of U.S. Provisional Application No. 60/796,053 filed on May 01, 2006 the entire disclosures of which are hereby incorporated by reference.

BACKGROUND OF THE INVENTION

Bridges across long, deep waterways are often unrealistic or impossible to build. Piers or other foundations placed between spans on deep or unstable waterway bottoms open face financially insurmountable obstacles. If pontoons could create a safe, stable foundation for say, a two-mile long, deep, open water crossing, such a bridge could cost 10% of that for an alternative two mile suspension span. Such a technology could permit bridges of almost any length at shockingly low prices. Patented, this technology would be best exploited during the patent monopoly years by building and owning private toll bridges with very long or perpetual toll franchises.

Objects and advantages of the invention are:

It uses water as foundation for the bridge tower.

Far less material is required per bridge.

It can be economically constructed in a shipyard and floated two or more standardized modules at a time comprising spans, towers and pontoons to the designated water crossing, erected and finished on site.

It is earthquake resistant.

Environmental impact of this floating bridge construction is far less than by other methods.

OBJECTS AND SUMMARY OF THE INVENTION

The objects and advantages of the invention, and others as well, are realized by a floating bridge and by a method of constructing a bridge over a wide waterway without having to build massive piers on the bottom of the waterway to support the bridge towers. Another object is to realize the economic advantages of repetitive remote fabrication probably in a modern shipyard of an essentially complete bridge; roadway truss, tower, pontoon and unique support legs.

In a broad form of the invention, marine vessels designed to be linked short term, or for long periods, span a waterway and function as a motor vehicle bridge. In a preferred embodiment; a cable stay bridge formed by one or more bridge modules extends across a waterway. Each bridge module includes a pontoon, a tower assembly, and a bridge deck assembly. Each tower supports a bridge deck/roadway centered at the tower, extending in opposite directions, supported by means of cable stays supported high on the tower and arrayed along the bridge deck/roadway. Each tower is supported in turn by a long pontoon floating below the base of the tower and extending in opposite directions from the tower but oriented transversely with the direction of the bridge deck/roadway. The tower consists of an assembly made up of a vertical mast attached to the pontoon and a cable stay support member designed to move up and down on the mast. The mast is supported by bipod legs, or brace members, anchored at the apex of the tower with their bases spread equidistant from the base of the tower on the pontoon. The pontoon is made long enough to prevent the tower from leaning due to wind on either side of the bridge. The pontoon, the mast and the mast supporting bipod legs are pivotally mounted to the bridge deck/roadway, cable stays, and cable stay support member to allow the pontoon, legs, cable stays, and support member to pivot right or left a few degrees without turning the roadway. By this means the pontoon can be oriented to align with tidal current flow but still stabilize the tower. The pontoon is tethered at its center pivotal as below the mast base from the bottom of the pontoon extending to the bottom of the waterway. The pontoon is also tethered from pontoon bottom to pontoon bottom at each pivotal axis by supplementary tethers between pontoons that supply a means to stabilize the spacing between the pontoons. The pontoon is also adjustably tethered from pontoon bottom at bow and stern by supplementary tethers between pontoons that supply a means to adjustably pivotally orient the pontoons to parallel variable water currents.

DETAILED DESCRIPTION OF PREFERRED EMBODIMENTS

Figure 1:
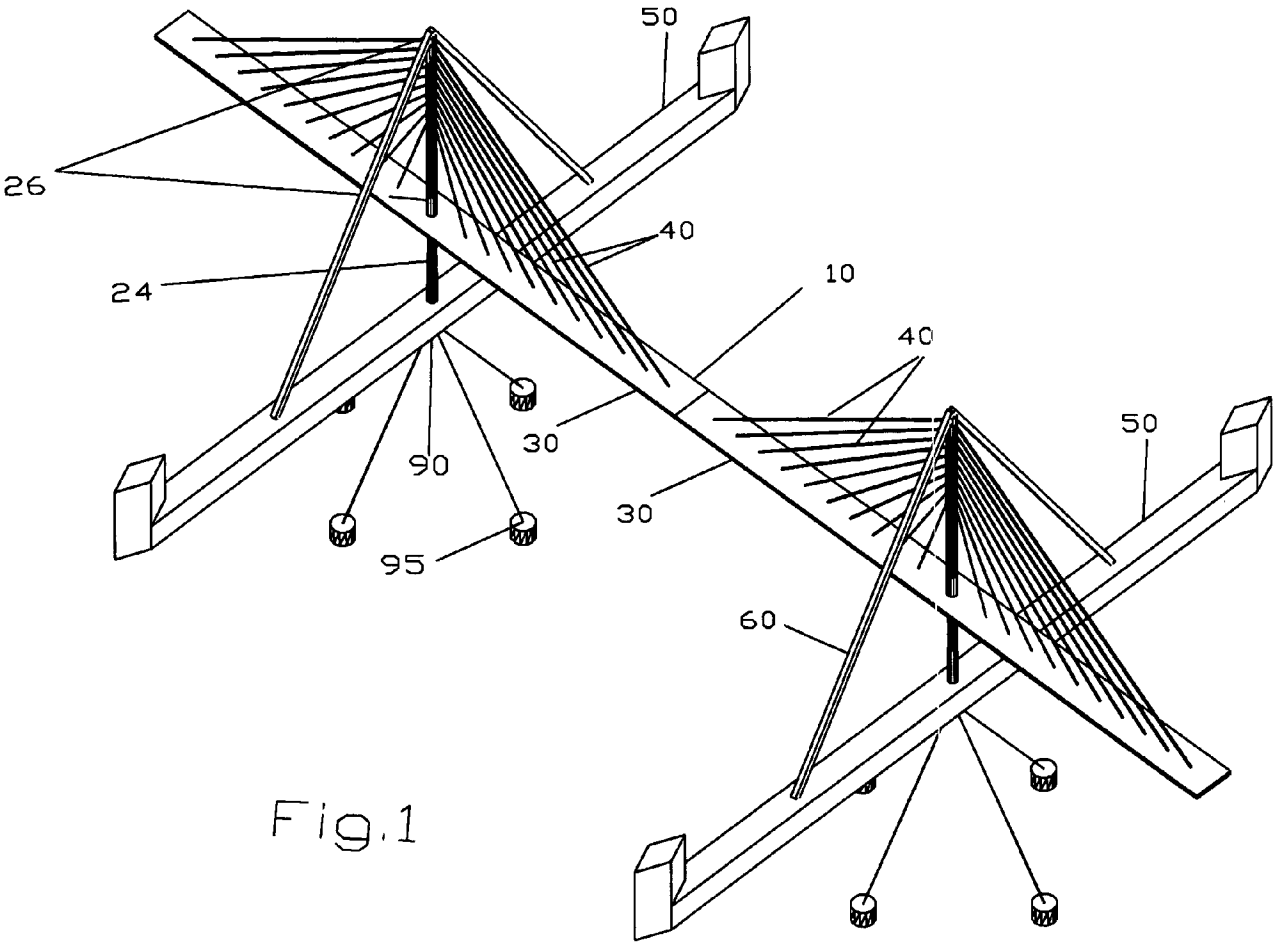
FIG. 1 is a perspective view of a floating bridge constructed according to the invention, with bridge modules erected and tethered to bottom of a body of water.

As shown, for example in FIG. 1, a cable stay bridge 10 formed by a pair of bridge modules is positioned across a waterway. Each bridge module includes a pontoon 50, a tower assembly 24, 26, and a bridge deck assembly 30. The tower consists of an assembly made up of a vertical mast 24, its base rigidly fastened to the pontoon midpoint and a cable stay support member 26 designed to move up and down on the mast. Each tower supports a module of bridge deck/roadway 30 centered at the tower and extending opposite directions from the tower supported by means of cable stays 40 anchored high on the cable stay support member and arrayed along the bridge deck/roadway. Each tower is supported in turn by a long pontoon 50 floating below the base of the tower, extending in opposite directions from the tower and oriented transversely relative to the direction of the bridge deck/roadway. The tower is supported by bipod legs 60 anchored at the apex of the mast with their bases spread equidistant from the base of the tower on the pontoon. The pontoon is made long and buoyant enough at the ends to prevent tower and bridge from leaning due to wind on either side of the bridge tower. The pontoon, the tower supporting legs and the mast as a unit are pivotally linked to the bridge deck/roadway, the cable stays, and the cable stay support member to allow the pontoon to swing right or left a few degrees without turning the tower. Wherein the elements are pivotally linked, to the mast, by a plurality of bearings, (26) spaced vertically along the mast; or by a pivotable sleeve member (26). By this means the pontoon can be oriented to parallel tidal current flow but still stabilize the tower. A tether is connected at its upper end to a pivoting bearing or torsion member 90 directly below the tower base and at its other end to the bottom 95 of the waterway.

Figure 2:
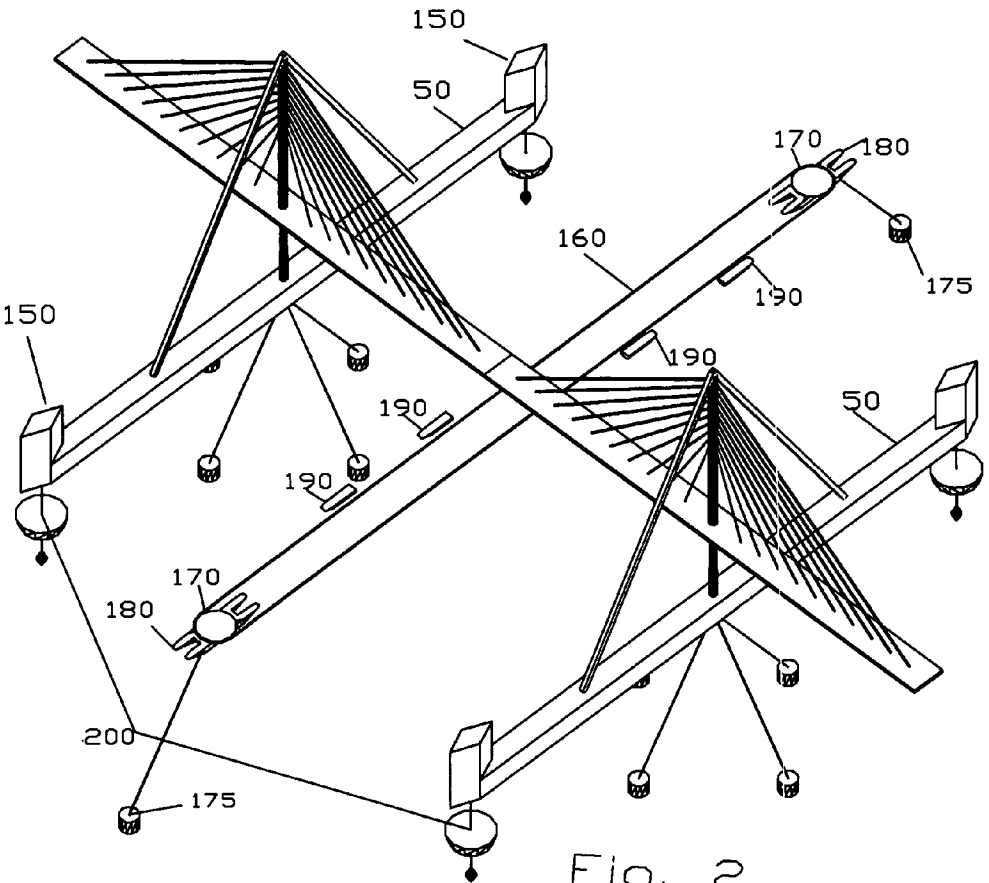
FIG. 2 is bridge constructed according to the invention, and showing drogues attached to the pontoons and a towing apparatus disposed between bridge modules.
Figure 5:
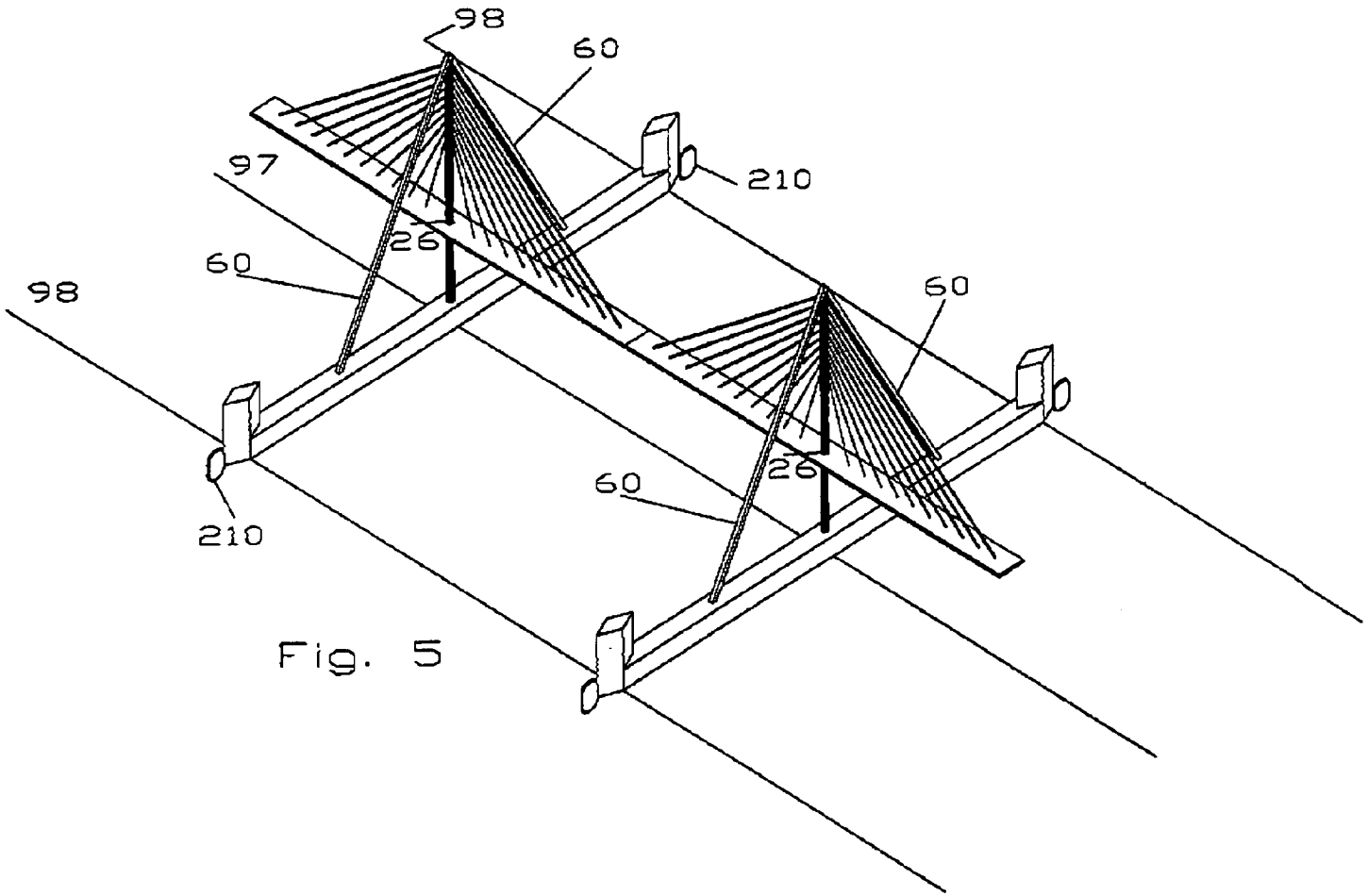
FIG. 5 is a perspective view showing the bridge modules with bridge cable stays and decks elevated and also showing supplementary tethers and rudders.

As shown in FIG. 2, the pontoons 50 are semi-submersibles with hulls tethered about sixty feet below water level save for water-surface-piercing buoyant chambers 150 at the bow and stern of the pontoon. The surface-piercing bow and stern chamber provides buoyant resistance to leaning of the bridge due to wind pressure. The buoyancy of the tethered submerged hull portion must be sufficient to support the dead load of the bridge module and with reserve buoyancy sufficient to support the design live load and stabilize the tower. As shown in FIG. 5, tethers 97 fastened to the pontoons below the pivotal axis of each pontoon extend between pontoons and provide a means to positionally stabilize the spacing between the pontoons and respective towers.

Figure 3:
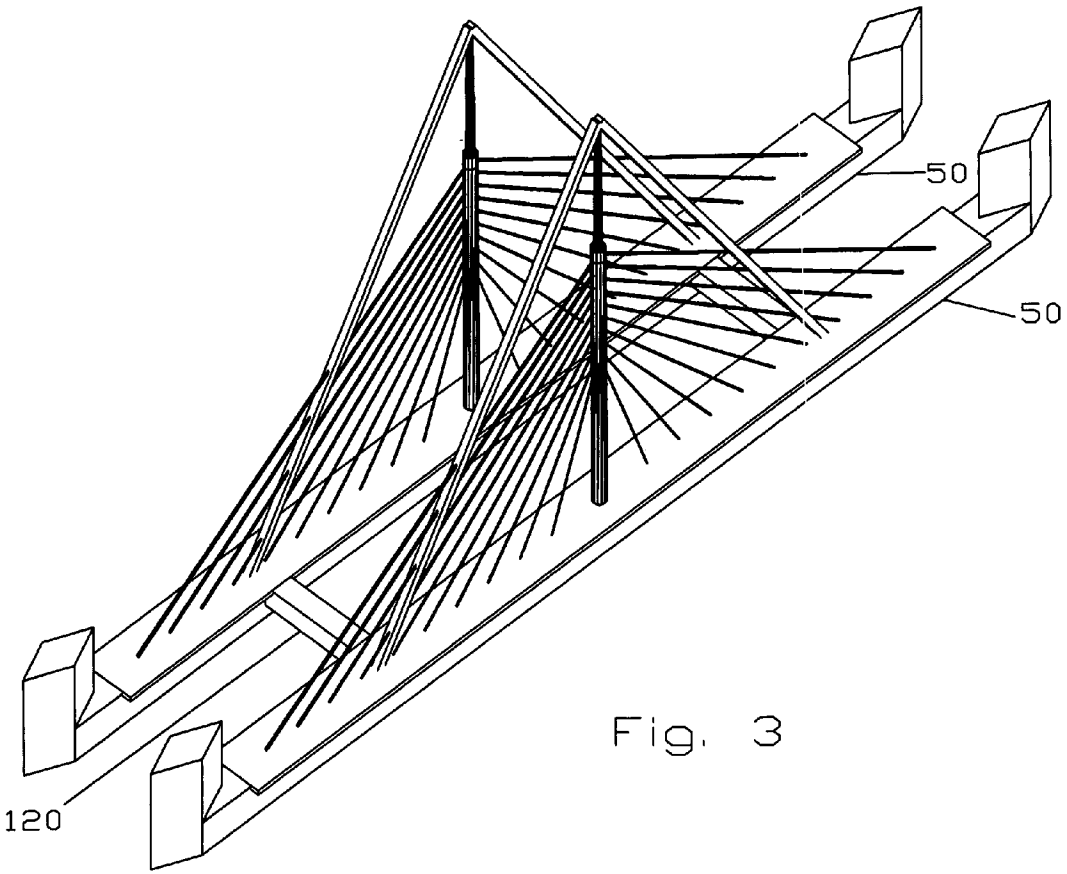
FIG. 3 is a perspective view of two bridge modules constructed remotely joined together to make them ocean-mobile for transport to a bridge site.
Figure 4:
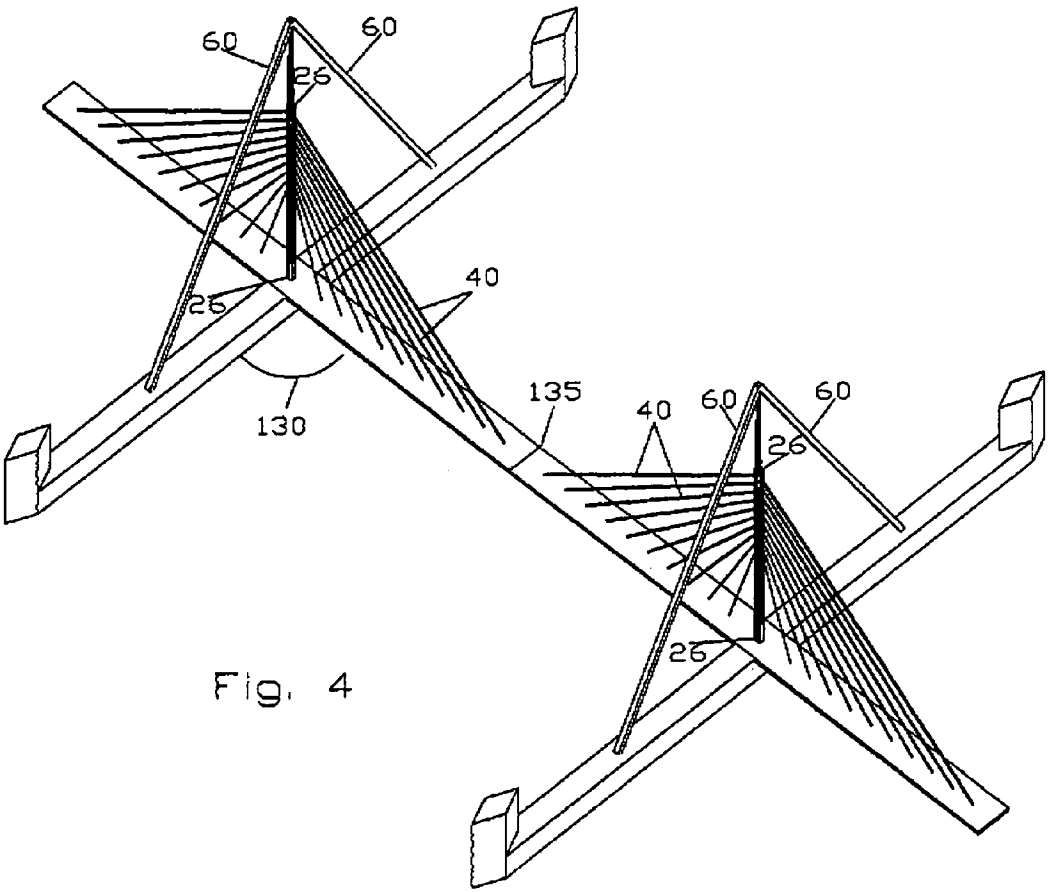
FIG. 4 is a perspective view showing bridge modules with bridge cable stays and decks rotated and decks linked at a bridge site and ready for elevation.

Referring to FIG. 3, the bridge is fabricated remotely with two (or more) pontoons 50 linked by temporary beams 120, catamaran fashion, to make a seaworthy vessel. The bridge deck/roadways are assembled on each corresponding pontoon deck. As shown in FIG. 4, at the intended bridge crossing site, the bridge deck/roadway, the cable stays, and the cable stay support member of each module will be rotated relative to the pontoon, mast support legs and mast about ninety degrees, as shown by 130, joined at 135 to the roadway of a similar adjoining module, and lifted as a paired bridge deck/roadway assembly along with supporting cable stays 40 to final elevation, about 200 feet, for example, to link with additional spans.

The position of the floating pivoting pontoons relative to towers and bridge deck/roadway is maintained by supplementary tethers. Referring again to FIG. 5, three tethers are employed, crossing beneath bridge pontoons module to module over the length of the crossing. One tether 97 passes beneath tower pivotal axes attached to rotating bearings or torsion members 90 beneath the pontoon midpoints. The bow and stern of each pontoon are adjustably attached to tethers 98 passing beneath the extreme ends of the pontoons. The ends of tethers 98 are fastened to anchorages that could be located, for example, to the bottom of the waterway beyond the ends of the bridge. Adjustment of pontoon angle along the tethers 98 can be performed by a mechanism that allows the ends of the pontoon to move along the cable and thereby effect pivoting of the pontoons about their midpoints. For example, the end of each pontoon could carry a capstan about which the tether could be wound. Rotation of the capstan by, for example, a bi-directional motor could effect the relative movement of the pontoon end relative to the tether. Other mechanisms, such as a rack and pinion, a hydraulic actuator or other well known mechanical actuators could also be used to effect movement of the pontoon ends along the tethers.

OTHER EMBODIMENTS

A bridge deck/roadway may be supported by a girder or arch supported on one end by a pontoon and on the other end by another pontoon or the shore.

Floating armoring barriers and alarm devices around the pontoons and associated bridge supports could be employed to protect them from collision by errant shipping vessels.

Figure 6:
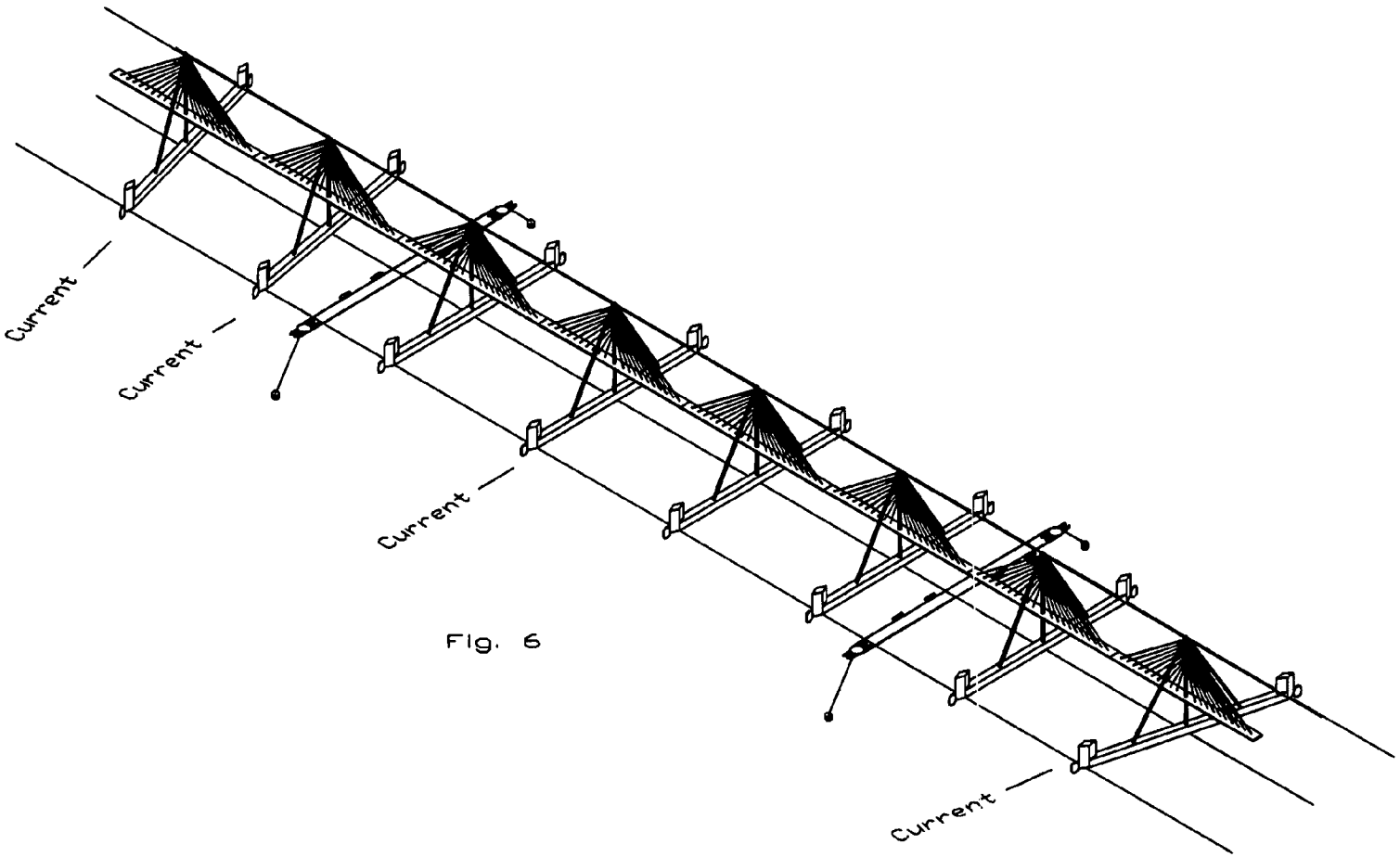
FIG. 6 is a perspective view showing bridge modules linked to create a bridged crossing with pontoons oriented parallel to varying currents and showing a pair of towing apparatuses.

As shown in FIGS. 2 and 6, a towing and guiding apparatus centered beneath one or more spans may be employed to move all but the largest vessels authorized to transit beneath the bridge. This apparatus includes an endless buoyant cable 160 passing around giant pulleys 170 turning on a vertical axis and mounted on each of two barges 180 moored at 175 and separated a suitable distance either side of a bridge span. Each small authorized vessel 190 would attach a bow line to the cable and many vessels would be drawn, spaced in a "daisy chain," beneath the bridge, in a safe controlled fashion, well clear of the vulnerable bridge structure. One side of the towing apparatus draws vessels under the bridge one direction. The returning endless cable draws vessels the other direction.

Again referring to FIG. 2, submerged drogues 200 may be attached to pontoon ends. They serve to damp any pitching moment or heaving caused by sudden large waves.

Referring again to FIG. 5, rudders 210 attached to pontoon ends provide a means to assist pivoting the pontoons to parallel tidal currents.

The invention claimed is:

1. A floating bridge having at least one bridge module deployed in a body of water, the bridge module comprising:

a buoyant pontoon supported by the body of water;

a tower assembly supported on the pontoon at a central location of the pontoon;

a bridge deck assembly including a bridge deck section suspended from the tower assembly by a plurality of suspension elements and oriented generally perpendicular to the pontoon; and wherein the pontoon is coupled to the bridge deck assembly for pivotal movement relative to the bridge deck assembly, by a pivoting means, wherein the pontoon can move within the body of water relative to the bridge deck assembly so as to be positioned generally parallel to variable water currents in the body of water.

2. The floating bridge as recited in claim 1, wherein:

the tower assembly includes a mast rigidly fastened at its lower end to the pontoon at the central location; and further comprising a pair of brace members serving as rigid links between the mast and the pontoon, each brace member fastened at one end to an upper end of the mast, extending in opposite directions downwardly and away from the mast and fastened at the other end thereof to the pontoon.

3. The floating bridge as recited in claim 2, wherein the pontoon, the mast and the brace members form an assembly that is pivotally mounted relative to the bridge deck assembly about an axis generally defined by the mast, to allow the pontoon to assume an orientation generally parallel to the changing water current direction and thereby minimize the pontoon profile in the water current.

4. The floating bridge as recited in claim 2, wherein:

the pivoting means includes a member mounted to the mast for upward and downward movement along the mast and pivotal movement about the mast;

the suspension elements are configured as cable stays supported at a plurality of levels by the support member and fastened at ends thereof to spaced locations along the bridge deck section.

5. The floating bridge as recited in claim 1, wherein the pontoon is held in position over a location on the bottom of the body of water by tethers fastened to the bottom of the pontoon in general alignment with its central location, the attachment of the tethers to the pontoon permitting limited pivotal movement of the pontoon about a vertical axis generally coinciding with the central location, to allow the pontoon to assume an orientation generally parallel to the changing water current direction and thereby minimize the pontoon profile in the water current.

6. The floating bridge as recited in claim 5, wherein the tethers serve to hold the pontoon below wave action occurring at the surface of the body of water.

7. The floating bridge as recited in claim 5, wherein the bridge is formed by a plurality of bridge modules with aligned and joined bridge deck sections, and further comprising supplementary tethers fastened to and extending between the pontoons below the central location of each pontoon to stabilize the spacing between the pontoons.

8. The floating bridge as recited in claim 1, wherein the pontoon is provided with a buoyant chamber near each end of the pontoon, the buoyant chambers extending at least partly above the surface of the body of water to create a righting moment that resists wind pressures on the bridge that would tend to cause leaning of the tower assembly.

9. The floating bridge as recited in claim 1, wherein a submerged drogue is attached to the pontoon near each end of the pontoon, whereby the pontoon is damped against excessive pitching or heaving caused by sudden large waves.

10. The floating bridge as recited in claim 5, wherein the bridge is formed by a plurality of bridge modules with aligned and joined bridge deck sections, and further comprising:

at least one supplementary tether fastened to each pontoon near each end thereof, the supplementary tethers extending between adjacent ends of neighboring pontoons, and a mechanism carried at each end of the pontoon and coupled to the supplementary tethers for moving the ends of the pontoons along the supplementary tethers and cause a pivotal movement of the pontoon about the vertical axis, to thereby effect an orientation of the pontoons that is generally parallel to variable water currents in the body of water.

11. A method of fabricating a floating bridge, the method comprising:

fabricating a bridge module by performing at least the following steps:

assembling a support member to a mast to form a tower assembly in which the support member is movable along the mast and pivotable about the mast;

joining the mast of the tower assembly to a central location on an upper surface of a pontoon with the mast extending upwardly from the pontoon;

assembling a pair of brace members to the mast and the pontoon, wherein one end of each brace member is fastened to an upper end of the mast, the brace members extend in opposite directions downwardly and away from the mast and the opposite ends of the brace members are fastened to the pontoon;

assembling a bridge deck section on the upper surface of the pontoon with the length of the bridge deck section being generally aligned with the length of the pontoon; and assembling suspension elements to the support member so as to be supported at a plurality of levels on the support member, and fastening ends of the suspension elements to spaced locations along the bridge deck section.

12. The method as recited in claim 11, wherein the bridge module is fabricated at a remote location, and further comprising:

joining two or more bridge modules to form a bridge module assembly that can serve as a seaworthy vessel;

transporting the bridge module assembly over water to an intended bridge crossing site;

separating the bridge modules of the bridge module assembly; and erecting the bridge modules to form a floating bridge.

13. The method as recited in claim 12, wherein the step of erecting further comprises:

a) rotating the bridge deck section of at least two of the bridge modules relative to the pontoon to a transverse position relative to the pontoon;

b) positioning the bridge deck sections of the at least two of the bridge modules in alignment end to end;

c) joining adjacent ends of the bridge deck sections of the at least two of the bridge modules;

d) arranging a first group of tethers between the pontoons of the at least two of the bridge modules and the bottom of a body of water at the bridge crossing site to effect stabilization of the bridge modules;

e) arranging a second group of tethers between the at least two of the bridge modules to effect stabilization of the bridge modules relative to each other;

f) elevating the support members, the suspension elements and the bridge deck sections of the at least two of the bridge modules, whereby the bridge deck sections of the at least two of the bridge modules are suspended in a position above the pontoons; and g) submerging the pontoons of the at least two of the bridge modules to positions in which the pontoons are located below wave action occurring at the surface of the body of water, and the bridge deck sections of the at least two of the bridge modules are located above the surface of the body of water.

14. The method as recited in claim 13, wherein the step of erecting further comprises:

performing steps a) through g) to erect at least two additional bridge modules; and joining the erected bridge modules to form a floating bridge of at least four modules.

15. The floating bridge as recited in claim 1, wherein the bridge includes at least two bridge modules with aligned and joined bridge deck sections, and further comprising a towing apparatus located centrally between the pontoons of adjacent bridge modules for towing and guiding vessels between the adjacent bridge modules, to thereby prevent collisions between the vessels and the adjacent bridge modules.

16. The floating bridge as recited in claim 15, wherein the towing apparatus comprises:

a pair of pulleys oriented for turning about vertical axes and positioned at spaced locations on opposite sides of the bridge deck sections of the adjacent bridge modules;

a motor coupled to at least one of the pulleys for turning the pulley; and an endless buoyant cable passing around the pulleys, whereby vessels can connect to the cable for safe transit under the bridge safely clear of the adjacent bridge modules.

17. The floating bridge as recited in claim 16, wherein the pulleys are mounted on barges moored at the spaced locations.

* * * * *